US006307138B1

(12) United States Patent
Simpson

(10) Patent No.: US 6,307,138 B1
(45) Date of Patent: Oct. 23, 2001

(54) PERCUSSION MALLET FOR MUSICAL INSTRUMENTS

(76) Inventor: Scott W Simpson, 54 Cedar St., Tappan, NY (US) 10983

( * ) Notice: Subject to any disclaimer, the term of this patent is extended or adjusted under 35 U.S.C. 154(b) by 0 days.

(21) Appl. No.: 09/624,835

(22) Filed: Jul. 25, 2000

(51) Int. Cl.[7] ..... G10D 13/02
(52) U.S. Cl. ..... 84/422.4
(58) Field of Search ..... 84/422.4, 422.1, 84/422.2

(56) References Cited

U.S. PATENT DOCUMENTS

| | | | | |
|---|---|---|---|---|
| D. 278,634 | * | 4/1985 | Anderson | D17/22 |
| 4,905,566 | * | 3/1990 | Hughlett et al. | 84/422.4 |
| 5,170,001 | * | 12/1992 | Amendola | 84/422.4 |
| 5,263,395 | * | 11/1993 | Phillips | 84/422.4 |
| 5,610,351 | * | 3/1997 | Yanagisawa | 84/422.1 |
| 5,929,356 | * | 7/1999 | Piland et al. | 84/422.4 |

* cited by examiner

*Primary Examiner*—Shih-Yung Hsieh
(74) *Attorney, Agent, or Firm*—Michael E. Zall

(57) ABSTRACT

A mallet for use by a percussionist for playing a percussion instrument. The mallet comprises an elongated shaft having a first head and a second head at opposite ends of the shaft. Each of these heads is used to produce a musical tone when struck against a percussion instrument. The shaft includes a first shaft portion proximate the first head and a second shaft portion proximate the second head. One of the first and second shaft portions is of greater thickness than the other shaft portion. The first head is made of a fibrous material, e.g., felt cover, for striking the percussion instrument. The second head is a non-fibrous material harder than the fibrous material, e.g., plastic, for striking another percussion instrument. When the percussionist strikes one instrument with the first head, the second shaft portion is held and when the percussionist strikes another instrument with the second head, the first shaft portion is held. For example, the percussionist can strike a timpani with the felt head, by holding onto the thicker second shaft, quickly flip the mallet over and holding the thinner second shaft, use the plastic head to strike a xylophone or bells. The thicker or thinner shaft provides the tactile indication needed by the musician to determine the head that is being used.

5 Claims, 1 Drawing Sheet

PERCUSSION MALLET FOR MUSICAL INSTRUMENTS

BACKGROUND OF THE INVENTION

1. Field of The Invention

This invention relates to mallets that can be used for playing percussion musical instruments. In particular, this invention may be used to play a timpani, cymbal or tom-tom with one end and play bells, xylophone or snare drum with the other end.

2. Prior Art

Prior art mallets generally comprise a shaft including one end which makes up a handle and the other end which is the head. One type of mallet head, used for a timpani, bass drum or tom-toms, or the like has traditionally been constructed of solid felt shaped generally in the form of a cylinder or sphere. Such mallet heads can also be wool or synthetic yarn. Sometimes, such fibrous mallet heads are replaced with rubber or plastic heads, i.e., polymeric heads. While these type heads are useful, the sound and feel of these mallets is not desirable for all uses that the percussionist may have to make while playing. For example, there are instances when a percussionist needs to move from one type instrument to another so rapidly that it is impossible for him or her to switch mallets. Consequently, the percussionist is forced to use an inappropriate mallet to play the instruments. In effect, the percussionist is forced to use a mallet that does not produce the preferred sound and tonal quality is sacrificed.

The following U.S. Patents are relevant background to the invention described and claimed herein:

U.S. Pat. No. 1,472,397 to Leedy describes a drum stick for snare drums. The drum stick has all of the advantages of the conventional, hard headed snare drum stick in playing the snare drum and has the added advantage that it can be used by the snare drummer for playing various other orchestra instruments. This is accomplished by replacing the conventional type of head of the usual snare drum stick with a substitute a soft head. In order to maintain the balance of the stick, the weight of the felt head is equal to the weight of the wood which would be allowed to remain on the spindle in event the conventional wooden beaded stick were used.

U.S. Pat. No. 1,739,275 to Zipperstein describes drum sticks having one head with an attachment for producing a metallic sound or ring when the head engages another metallic body.

U.S. Pat. No. 1,892,416 to Vitto describes a tympani stick having a handle, a flat head fixed on one end of the handle in a plane at right angles thereto. The head includes a hard central finger-like core, a comparatively stiff cushion on opposite sides of the core and across one end of the core. The edge of the cushion is curved in the area of a circle about the end of the core, and a strip of soft cushioning material overlays and extends along the edge of the cushion. The stick provides all of the advantages resulting from blows struck by a cushion and, at the same time, causes a sharply defined tone to be obtained upon striking the drum membrane.

U.S. Pat. No. 1,953,619 to Ludwig describes drumsticks for producing a rumbling noise from drums, i.e., rumble tips for drum sticks. The rumble tip includes a circular disk or washer which is made of soft rubber and can be applied to drum sticks of various sizes or thicknesses.

U.S. Pat. No. 2,853,912 to Gladstone describes a hammer for percussion musical instruments, such as, xylophones, the vibraharp, chimes and similar instruments from which tonal effects are obtained by striking metal or wood bars. The hammer head is a plastic ball having a specific structure.

U.S. Pat. No. 2,905,043 to Soderberg describes a mallet unit including a pair of mallets which are used with percussion musical instruments such as vibraphone, xylophone, marimba and the like. The pair of mallets are pivotally connected to each other allow a change of spread between the mallet heads and are also adjustable in length one with the other. Such construction permits the playing of certain chords without the need for crossing mallets or the placing of one hand under the other.

U.S. Pat. No. 4,545,836 to Lidster describes a marimba/xylophone mallet wherein a colored liquid rubber is solidified into layer strips which are wrapped about a spheroid. A set of such mallets are formed with each mallet having a different color of mallet head and each varying in timbre.

U.S. Pat. No. 4,632,006 to Ambroszewski describes a removable drumstick mallet head having a hollow rubber core the bore of which is sized to fit over the end of a drumstick, and a cover, preferably of felt, drawn down tightly over the core. The drumstick with the mallet head in place may be flipped over and used as a soft mallet on for example tom toms, cymbals and timpani.

U.S. Pat. No. 5,263,395 to Phillips describes a mallet for playing a percussion instrument having a handle and a head. The head has different sound-producing properties at different locations on the head. In particular, the hardness and/or diameter of the head varies relative to the longitudinal axis of the handle, such that the differing sounds dependent on the orientation of the head relative to the longitudinal axis of the handle can be obtained.

U.S. Pat. No. 5,929,356 to Piland et al describes a mallet for striking a musical instrument. The mallet comprises a shaft and a head connected to one end of the shaft. A layer of short fibers is adhered to the surface of the head. The other end of the shaft has a finial for gripping the mallet.

U.S. Pat. No. Des. 264,977 to Starks shows a design for a drum mallet having identical rounded ends.

OBJECTS AND SUMMARY OF THE INVENTION

It is an object of this invention to provide a mallet for percussion instruments that has two different type heads.

It is a further object of this invention to provide a mallet having two heads that may be quickly flipped from one head to the other.

It is yet another object of this invention to provide a mallet having two heads that may be quickly flipped from one head to the other so that different percussion instruments may be played.

It is still another object of this invention to provide a mallet having two heads that may be quickly flipped from one head to the other so that different percussion instruments may be played and the shaft between the heads provides a clear tactile indication to the musician as to the head being used.

It is still a further object of this invention to provide a mallet that is balanced and weighted in such a manner that each end of the mallet has the appropriate feel and response needed for playing the designated instrument.

All of the foregoing objects are provided by the mallet of this invention. Broadly, the mallet comprises an elongated shaft having a first head and a second head at opposite ends of the shaft. Each of these heads is used to produce a musical tone when struck against a percussion instrument. The shaft includes a first shaft portion proximate the first head and a second shaft portion proximate the second head. One of the first and second shaft portions is of greater thickness than the other shaft portion. The first head is made of a fibrous material, e.g., felt cover, for striking the percussion instrument. The second head is a non-fibrous material harder than the fibrous material, e.g., plastic, for striking another percussion instrument. When the percussionist strikes one instrument with the first head, the second shaft portion is held and when the percussionist strikes another instrument with the second head, the first shaft portion is held. For example, the percussionist can strike a timpani with the felt head, by holding onto the thicker second shaft, quickly flip the mallet over and holding the thinner first shaft, use the plastic head to strike a xylophone or bells. The thicker or thinner shaft provides the tactile indication needed by the musician to determine the head that is being used and also provides the required balance, feel and response appropriate to the respective head for playing the desired instrument.

DETAILED DESCRIPTION OF INVENTION

Figure 1:
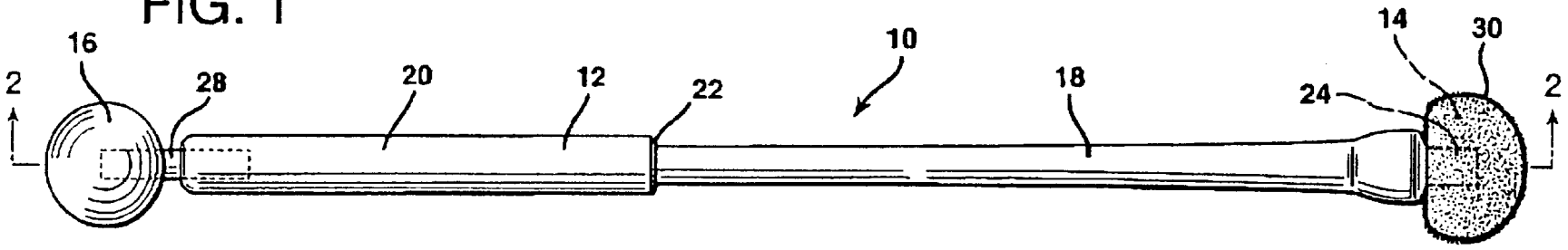
FIG. 1 is a side view of the mallet of this invention.
Figure 2:
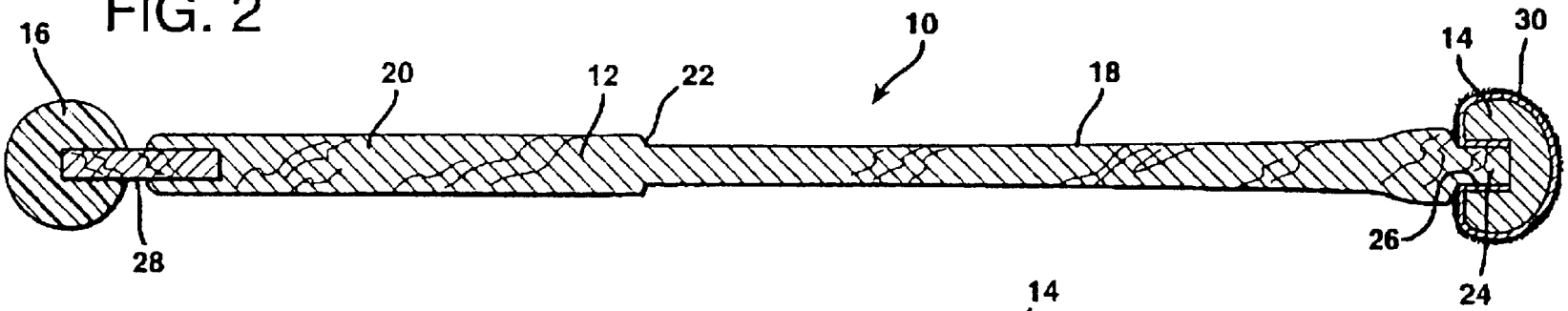
FIG. 2 is a cross-sectional view of the mallet of FIG. 1 taken along line 2—2 of FIG. 1.
Figure 3:
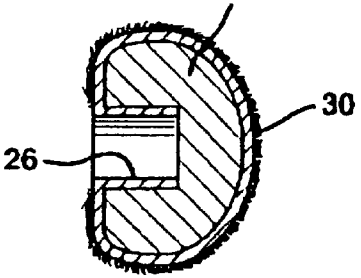
FIG. 3 is a cross-sectional view of the felt-head of the mallet.

Referring to FIGS. 1–3, the mallet 10 of this invention is used by a percussionist for playing a percussion instrument (not shown). Preferably the mallet 10 is used for playing the timpani and the bells and/or xylophone by the same percussionist in the same musical piece. However, more broadly, the mallet 10 may be used on a first group of instruments consisting of a timpani, cymbal, tom-tom, marimba and vibraphone and on another percussion instrument selected from a second group of instruments consisting of a xylophone, bells and snare drums by the same percussionist in the same musical piece.

The mallet 10 comprises an elongated shaft 12 having a first head 14 and a second head 16 at opposite ends of the shaft 12. Each of these heads 14, 16 is used to produce a musical tone when struck against a percussion instrument. The shaft 12 includes a first shaft portion 18 proximate the first head 14 and a second shaft portion 20 proximate the second head 16. One of the first 18 and second 20 shaft portions is of greater thickness than the other shaft portion. Preferably the shaft 12, including the shaft portions 18, 20, are substantially cylindrical and the second shaft portion 20 is of greater diameter than the first shaft portion 18.

In its preferred embodiment the shaft 12 is made of ramin, maple or oak wood. However, any material may be used that permits the mallet 10 to accomplish its intended purpose. Referring to the Figures, and in particular FIG. 2, the first shaft portion 18 that abuts against the first head 14 preferably has a diameter of about 23/32 inches. Referring to FIG. 2, moving along the shaft to the left, the diameter gradually tapers down to 11/16 inches at about ¼ inch from the first head 14. Still moving along the shaft to the left, the diameter further tapers down to ½ inch at about ½ inch from the first head 14. The shaft then gradually tapers to ⅜ inch for the remaining portion of the first shaft portion 18. Preferably, the first shaft 18 is 8 inches long from the end of the first head 14 to ridge 22. At ridge 22, which is the initiation of the second shaft element 20, the diameter of the shaft 12 abruptly increases. In the preferred embodiment, this increases to about 9/16 inches. This diameter is maintained for about 5 inches. At the end of this second shaft section 20 the second head 16 is mounted.

Still referring to FIGS. 1–3, the first head 14 is made of a fibrous material, e.g., felt. In the preferred embodiment, the head 14 is substantially, spherical form and the core is made of wood or plastic and is about ½ inch in diameter. The end first shaft portion 18, has a nub 24 which is about ⅜ inch in diameter and 15/16 inches long. First nub 24 mates in a hole 26 provided in first head 14. Preferably head 14 is glued onto nub 24. Preferably a felt cover material 30 is glued and/or sewn over first head 14. Other materials suitable, for example, for a tympani may be substituted for the felt and other methods of construction may be utilized.

The second head 16 is preferably a non-fibrous material harder than the first head 14. A preferred material is a plastic such as Lexan® (DuPont), a phenolic type plastic, HDPE, or other well known plastic typically used for the head of a mallet used for xylophones or bells. Referring to FIG. 2, in the preferred embodiment a second nub 28, preferably made of rattan, projects from the end of the second shaft portion 20. This nub 28 is glued into a mating hole in the end of second shaft portion 20. In the preferred embodiment, this hole is 19/32 inches deep and ¼ inch in diameter. The total length of second nub 28 is about 1 ½ inches, with about 19/32 inches embedded in the end of second shaft portion 20. Most, but not all, of the remaining portion of second nub 28 is embedded in a mating hole in the plastic second head 16. This hole is about 17/32 inches deep. Preferably, second head 16 is about 1 ⅛ inches in diameter, although other diameters may be used.

When the percussionist strikes one instrument, for example a tympani, with the first head 14, the second shaft portion 20 is held and when the percussionist strikes another instrument, for example bells and/or xylophone, with the second head 16, the first shaft portion 18 is held. For example, the percussionist can strike a timpani with the felt head 14, by holding onto the thicker second shaft 20, quickly flip the mallet 10 over and holding the thinner second shaft 18, use the plastic head 16 to strike a xylophone or bells. The thicker 20 or thinner 18 shaft provides the tactile indication needed by the musician to determine the head that is being used. Such a structure also provides a mallet that is balanced and weighted in such a manner that each end of the mallet has the appropriate feel and response needed for playing the designated instrument.

The mallet 10 of this invention, excluding the exterior of the heads 16,14, may be made of ramin, maple or oak wood.

The mallet of this invention is unique in that it provides the percussionist with the feel and response true to a single headed mallet. For example, when the percussionist is playing the timpani the mallet feels like a timpani mallet and when the percussionist is playing the bells and/or xylophone, the mallet feels like a bell/xylophone mallet. The design is such that there is a proper balance at the fulcrum between the heads. The sudden change in thickness in the shaft provides the percussionist with a sufficient tactile signal so that a determination can be made as to the head that is being used. The mallet of this invention is useful to any percussionist, particularly those playing Broadway Musicals and other repertoire that require the percussionist to move quickly between multiple percussion instruments and provide the optimum tone quality, i.e., timbre.

While this invention has been described as having preferred designs, it will be understood that it is capable of further modification. This application is therefore intended to cover any variations, uses or adaptations of the invention following the general principles thereof and including such departure from the present disclosure as come within known or customary practice in the art.

What is claimed is:

1. A mallet for use by a percussionist for playing a percussion instrument comprising:

an elongated cylindrical shaft having at opposite ends of the shaft a first percussion instrument mallet head adapted to produce a musical tone when struck against the percussion instrument and a second percussion instrument mallet head adapted to produce a musical tone when struck against the percussion instrument;

the first head comprising a fibrous material; and the second head comprising a non-fibrous material harder than the fibrous material;

the shaft comprising a first cylindrical shaft portion proximate the first head and a second cylindrical shaft portion proximate the second head, wherein one of the first and second shaft portions is of greater diameter than the other shaft portion, wherein where the first shaft portion and second shaft portion abut each other between the heads, the differences in diameters of the shaft portions form a ridge;

wherein when the percussionist strikes the instrument with the first head, the second shaft portion is held and when the percussionist strikes the instrument with the second head, the first shaft portion is held, whereby the ridge formed by the differences in diameters of the shaft portions and the different diameters of the shaft portions, coact to provide the percussionist with a sufficient tactile signal so that a determination can be made by the percussionist as to the head that is being used.

2. The mallet of claim 1, wherein the second shaft portion is of greater diameter than the first shaft portion.

3. The mallet of claim 1, wherein the first head is a substantially spherical felt head.

4. The mallet of claim 1, wherein the second head is a substantially spherical plastic head.

5. The mallet of claim 1, wherein the first head is a substantially spherical felt head and the second head is a substantially spherical plastic head.

* * * * *